US008555687B2

(12) United States Patent
Ishige et al.

(10) Patent No.: US 8,555,687 B2
(45) Date of Patent: Oct. 15, 2013

(54) HOT ROLLING APPARATUS

(75) Inventors: Kengo Ishige, Tokyo (JP); Yasuo Matsunaga, Yokohama (JP); Hiroyuki Otsuka, Yokohama (JP); Kenichi Ide, Yokohama (JP); Masahiro Kuchi, Yokohama (JP); Hisashi Honjou, Yokohama (JP)

(73) Assignees: IHI Corporation (JP); IHI Metaltech Co., Ltd. (JP)

( * ) Notice: Subject to any disclaimer, the term of this patent is extended or adjusted under 35 U.S.C. 154(b) by 456 days.

(21) Appl. No.: 12/664,472

(22) PCT Filed: Jun. 18, 2008

(86) PCT No.: PCT/JP2008/061120

§ 371 (c)(1),
(2), (4) Date: Dec. 14, 2009

(87) PCT Pub. No.: WO2008/156106

PCT Pub. Date: Dec. 24, 2008

(65) Prior Publication Data

US 2010/0180655 A1 Jul. 22, 2010

(30) Foreign Application Priority Data

Jun. 18, 2007 (JP) ..... 2007-160367

(51) Int. Cl.
*B21B 13/08* (2006.01)

(52) U.S. Cl.
USPC ..... 72/234; 72/200; 72/201; 72/202; 29/527.7

(58) Field of Classification Search
USPC ..... 72/38, 200, 201, 202, 234, 250, 342.1, 72/342.2, 342.5, 342.6
See application file for complete search history.

(56) References Cited

U.S. PATENT DOCUMENTS 3,803,891 A 4/1974 Smith
4,008,103 A * 2/1977 Miyoshi et al. ..... 148/653
(Continued)

FOREIGN PATENT DOCUMENTS

GB 918005 2/1963
GB 1373375 11/1974
(Continued)

OTHER PUBLICATIONS

Japanese Office Action, dated Nov. 13, 2012, issued in corresponding Japanese Patent Application No. 2007-160367. Total 4 pages, including English Translation.

(Continued)

*Primary Examiner* — Dana Ross
*Assistant Examiner* — Homer Boyer
(74) *Attorney, Agent, or Firm* — Ostrolenk Faber LLP

(57) ABSTRACT

The present disclosure relates to a hot rolling apparatus for manufacturing a metal plate by hot-rolling-treating a metal material including copper. The apparatus includes: a rough rolling device for rolling-treating the metal material, which has been heating-treated, a plurality of times with a back-and-forth movement of the metal material, to mold the metal material into a metal plate; a heat retention/application treatment device for retaining heat of or applying heat to the metal plate molded by the rough rolling device at lower temperatures than in the heating treatment, without applying bending; a finish rolling device for further rolling-treating the metal plate that has been heat-treated by the heat retention/application treatment device; a cooling device for cooling the metal plate that has been rolling-treated by the finish rolling device; and a support table for movably supporting the metal plate from below before and after the rough rolling device while the metal material is moved back and forth by the rough rolling device. According to the present disclosure, it is possible to improve the quality of the metal plate manufactured in the hot rolling apparatus, and also to improve the speed of the process required for rolling.

4 Claims, 4 Drawing Sheets

(56) References Cited

U.S. PATENT DOCUMENTS

| | | | | | |
|---|---|---|---|---|---|
| 4,319,474 | A | | 3/1982 | Gronbech | 72/229 |
| 4,407,486 | A | * | 10/1983 | Mills et al. | 266/87 |
| 5,970,773 | A | * | 10/1999 | Engel et al. | 72/251 |
| 6,527,882 | B1 | | 3/2003 | Wehage | 148/541 |
| 6,898,954 | B2 | * | 5/2005 | Twigg et al. | 72/38 |
| 2003/0051525 | A1 | * | 3/2003 | Kramer | 72/229 |

FOREIGN PATENT DOCUMENTS

| | | | | |
|---|---|---|---|---|
| JP | S48-62651 | | | 9/1973 |
| JP | 62-187505 | | | 8/1987 |
| JP | 1-107906 | A | | 4/1989 |
| JP | 07-188739 | | | 7/1995 |
| JP | 09-314216 | | | 12/1997 |
| JP | 2001-025810 | | * | 7/1999 |
| JP | 2000-246309 | A | | 9/2000 |
| JP | 3146786 | B2 | | 3/2001 |
| JP | 2002-508253 | | | 3/2002 |
| JP | 2003-290812 | | | 10/2003 |
| JP | 2004-223523 | A | | 8/2004 |

OTHER PUBLICATIONS

European Search Report, dated Nov. 30, 2012, issued in corresponding European Application No. 08777319.8. Total 10 pages.

* cited by examiner

HOT ROLLING APPARATUS

CROSS REFERENCE TO RELATED APPLICATIONS

The present application is a 35 U.S.C. §371 National Phase conversion of PCT/JP2008/061120, filed Jun. 18, 2008, which claims benefit of Japanese Application No. 2007-160367, filed Jun. 18, 2007, the disclosure of which is incorporated herein by reference. The PCT International Application was published in the Japanese language.

TECHNICAL FIELD

The present invention relates to a hot rolling apparatus that hot-rolls a metal plate including copper.

BACKGROUND ART

As apparatuses for manufacturing a metal plate by hot-rolling-treating scrap material (a metal material) mainly composed of steel and including copper, hot rolling apparatuses are conventionally used in which a heat-treated metal material is thinned through a plurality of hot rolling operations by a rolling mill.

Some of such hot rolling apparatuses have a construction in which there is arranged in a line: a roughing mill for rolling the metal material heat-treated to an elevated temperature a plurality of times while passing the metal material back and forth, to thereby mold the metal material into a metal plate; a heat-retention chamber for, for example, keeping the metal plate molded by the roughing mill at temperatures lower than that in the heating treatment; a finishing mill train for finish-rolling the metal plate that has been carried out of the heat-retention chamber; and a cooling apparatus for cooling the metal plate that has been carried out of the finishing mill train.

For example, Patent Document 1 discloses a hot rolling apparatus in which a coil box that stores the metal plate molded by the roughing mill in a predetermined temperature atmosphere after coiling is placed as the heat-retention chamber. According to the hot rolling apparatus disclosed in Patent Document 1, a metal plate is coiled in the coil box. Therefore, it is possible to realize a hot rolling apparatus with a reduced line length.

Patent Document 2 discloses a hot rolling apparatus that rolls a metal material simultaneously with a roughing mill and a finishing mill train. According to the hot rolling apparatus disclosed in Patent Document 2, it is possible to realize a compact hot rolling apparatus in which a metal material is continuously processed with a roughing mill and a finishing mill train.

Patent Document 1: Unexamined Japanese Patent Application, First Publication No. S48-62651

Patent Document 2: Japanese Patent No. 3146786

DISCLOSURE OF INVENTION

Problem that the Invention is to Solve

In hot rolling apparatuses, when a metal material before undergoing rolling processing by the roughing mill is heat-treated at elevated temperatures, the surface of the metal plate is oxidized, and hence a so-called primary scale (oxide layer) is formed. The primary scale is removed before the metal plate is supplied to the roughing mill. Furthermore, in contrast to the primary scale formed before the metal plate is supplied to the roughing mill, a so-called secondary scale (oxide film) is formed on the surface of the metal plate after the metal plate is carried out of the roughing mill until it is cooled.

The secondary scale is formed especially when a metal plate is between the roughing mill and the finishing mill train. Copper is more resistant to oxidation than iron. Therefore, in the process to the formation of the secondary scale, iron is oxidized on the surface of the metal plate by priority, to thereby form an oxide layer. After that, copper coagulates on the interface between the iron oxide layer and the copper. This precipitates as liquid and permeates into the grain boundary on the surface of the copper. This makes the metal plate brittle. That is, the formation of a secondary scale makes the metal plate brittle.

Conventionally, the degree of brittleness of a metal plate caused by the secondary scale was not problematic. However, in recent years, improvement in the quality of a metal plate has been desired. This results in the necessity of addressing the brittleness of a metal plate caused by the secondary scale.

Especially in the hot rolling apparatuses disclosed in Patent Documents 1 and 2, the metal plate on which a secondary scale is formed is coiled. Therefore, there is a possibility that the metal plate is damaged in a minuscule area when it is bent, due to the metal plate having become brittle. In Patent Document 1, the temperature of the metal plate is retained in a state of being coiled in the coil box. Therefore, the end portions in the width direction of the metal plate, and the area thereof in contact with a coiling mandrel are likely to be cooled. This results in a problem in that unevenness in temperature distribution is likely to occur when the coiled metal plate is regarded as a block. Unevenness in temperature distribution of the metal plate leads to nonuniformity in quality of the metal plate.

Furthermore, in hot rolling apparatuses, it is desired that the time required to manufacture a metal plated from scrap material be made shorter.

For example, in the hot rolling apparatus disclosed in Patent Document 2, a heat-retention chamber is placed between the roughing mill and the finishing mill train. In the hot rolling apparatus, the period of time in which a metal plate is present in the heat-retention chamber is long and the number of times the metal plate is introduced into the heat-retention chamber is large, leading to a larger amount of produced scale. The metal material rolled by the roughing mill is made thinner through a plurality of rolling operations. During the operations, warpage may occur in the metal material.

Therefore, for safe passage of the head end of a plate through a storage chamber, it is not possible to increase the transfer speed of a metal material. Therefore, it is not possible to increase the rolling speed to shorten the period of time in which the metal plate is present in the heat-retention chamber. If the rolling speed is low, the secondary scale becomes thicker, which reduces productivity. Moreover, the rolling speed on the final path of the roughing rolling is decreased because the roughing rolling and the finishing rolling are performed simultaneously in the final path.

Means for Solving the Problem

The present invention has been achieved in view of the aforementioned problems, and has objects as follows:

(1) to improve the quality of metal plates manufactured by the hot rolling apparatus.

(2) to improve the speed of the process in the hot rolling apparatus.

To achieve the above objects, the present invention is a hot rolling apparatus for manufacturing a metal plate by hot-rolling-treating a metal material including copper, including: a rough rolling device for rolling-treating the metal material, which has been heat-treated, a plurality of times with a back-and-forth movement of the metal material, to mold the metal material into a metal plate; a heat retention/application treatment device for retaining heat of or applying heat to the metal plate molded by the rough rolling device at lower temperatures than in the heating treatment, without applying bending; a finish rolling device for further rolling-treating the metal plate that has been heat-treated by the heat retention/application treatment device; a cooling device for cooling the metal plate that has been rolling-treated by the finish rolling device; and a support table for movably supporting the metal material from below before and after the rough rolling device while the metal plate is moved back and forth by the rough rolling device.

According to the present invention, while the metal material is moved back and forth by the rough rolling device, that is, while the metal material is rolled by the rough rolling device, the metal material is movably supported from below by the support table.

Furthermore, the metal plate molded by the rough rolling device is heat-treated by the heat in the retention/application treatment device without being bent.

In the present invention, it is desirable that the support table further include a posterior support table for movably supporting metal material from below between the rough rolling device and the heat retention/application treatment device. A length of the posterior support table is set greater than a length by which the metal plate protrudes from the rough rolling device in a final back-and-forth movement of the metal material from the rough rolling device toward the heat retention/application treatment device.

It is desirable that the present invention further include an oxygen concentration control device for maintaining an atmosphere of the heat-treatment in the heat retention/application treatment device to an oxygen concentration of below 3%.

Next, the present invention is a hot rolling apparatus for manufacturing a metal plate by hot-rolling-treating a metal material including copper, including: a rough rolling device for rolling-treating the metal material, which has been heat-treated, a plurality of times with a back-and-forth movement of the metal material, to mold the metal material into a metal plate; a heat retention/application treatment device for retaining heat of or applying heat to the metal plate molded by the rough rolling device at lower temperatures than in the heating treatment; a finish rolling device for further rolling-treating the metal plate that has been heat-treated by the heat retention/application treatment device; a cooling device for cooling the metal plate that has been rolling-treated by the finish rolling device; and an oxygen concentration control device for maintaining an atmosphere of the heat-treatment in the heat retention/application treatment device to an oxygen concentration of below 3%.

According to the present invention, the atmosphere of the heat-treatment in the heat retention/application treatment device is maintained to an oxygen concentration of below 3% by the oxygen concentration control device.

Advantage of the Invention

According to the present invention, the metal plate having been rolled by the rough rolling device is heat-treated in the heat retention/application treatment device without being bent. Therefore, the metal plate on which secondary scale is formed is never coiled. Consequently, damage such as a microcrack resulting from the metal plate becoming brittle can be prevented from occurring in the metal plate. Furthermore, according to the present invention, the metal plate is not heat-treated in a state of being coiled in the coil box. This makes the temperature distribution of the metal plate even, and hence makes the quality of the metal plate uniform. Furthermore, the temperature distribution of the metal plate is made even in the heat retention/application treatment device. This eliminates the necessity of fine temperature control during cooling. Therefore, it is possible to improve the processing speed of the cooling device at the subsequent stage, and to diminish the size of the cooling device.

Furthermore, according to the present invention while the metal material is moved back and forth by the rough rolling device, that is, while the metal material is rolled by the rough rolling device, the metal material is movably supported from below by the support table. Therefore, while the metal material is rolled by the roughing rolling device, the metal material is never made available for another process such as heat retention in, for example, the storage chamber. As a result, while being rolled by the rough rolling device, the transfer speed of the metal material is never under the control resulting from another process. Consequently, it is possible to improve the transfer speed of the metal material, that is, improve the rolling speed in the rough rolling device. That is, because the present invention does not perform rolling-treatment simultaneously with the rough rolling device and the finish rolling device, it is possible to improve the rolling speed and to increase the moving speed of the metal material.

Thus, according to the present invention, it is possible to improve the quality of the metal plate manufactured in the hot rolling apparatus, and also to improve the speed of the process required for rolling.

Next, according to the present invention, the oxygen concentration in the atmosphere of the heat-treatment in the heat retention/application treatment device is maintained below 3% by the oxygen concentration control device.

If the oxygen concentration in the atmosphere of the heat-treatment in the heat retention/application treatment device is below 3%, it is possible to reduce the thickness of the secondary scale formed on the surface of the metal plate. The thickness of the secondary scale is proportional to the amount of produced secondary scale, that is, the amount of precipitated copper in liquid form. Therefore, as in the present invention, the thickness of the secondary scale is reduced, which leads to a decrease in the amount of produced copper in liquid form. As a result, it is possible to prevent the metal plate from suffering from brittleness caused by the permeation of liquid crystal copper into the metal material grain boundary of steel or the like.

Therefore, according to the present invention, it is possible to improve the quality of the metal plate manufactured in the hot rolling apparatus.

DESCRIPTION OF THE REFERENCE SYMBOLS

1: hot rolling apparatus, 2: heating furnace, 3: anterior table (support table), 4: descaling apparatus, 5: roughing mill (rough rolling device), 6: posterior table (support table), 7: linear heating furnace (heat retention/application treatment device), 8: oxygen concentration control apparatus (oxygen concentration control device), 10: finishing mill train (finish rolling device), 11: cooling apparatus, X: slab (metal material), Y: metal plate

BEST MODE FOR CARRYING OUT THE INVENTION

Hereunder is a description of one embodiment of a hot rolling apparatus according to the present invention, with reference to the drawings. In the following drawings, scale ratios among the constituent elements are appropriately modified to make their size recognizable.

Figure 1:
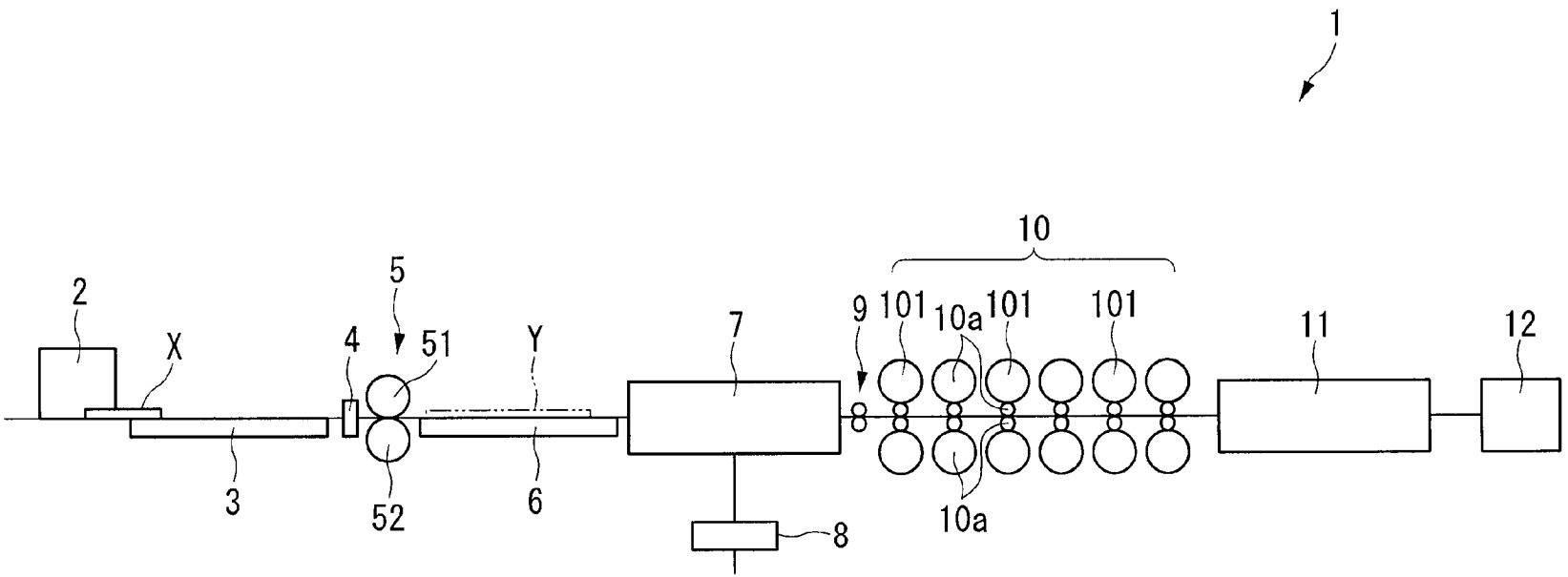
FIG. 1 is a schematic block diagram showing a hot rolling apparatus as one embodiment of the present invention.
Figure 2:
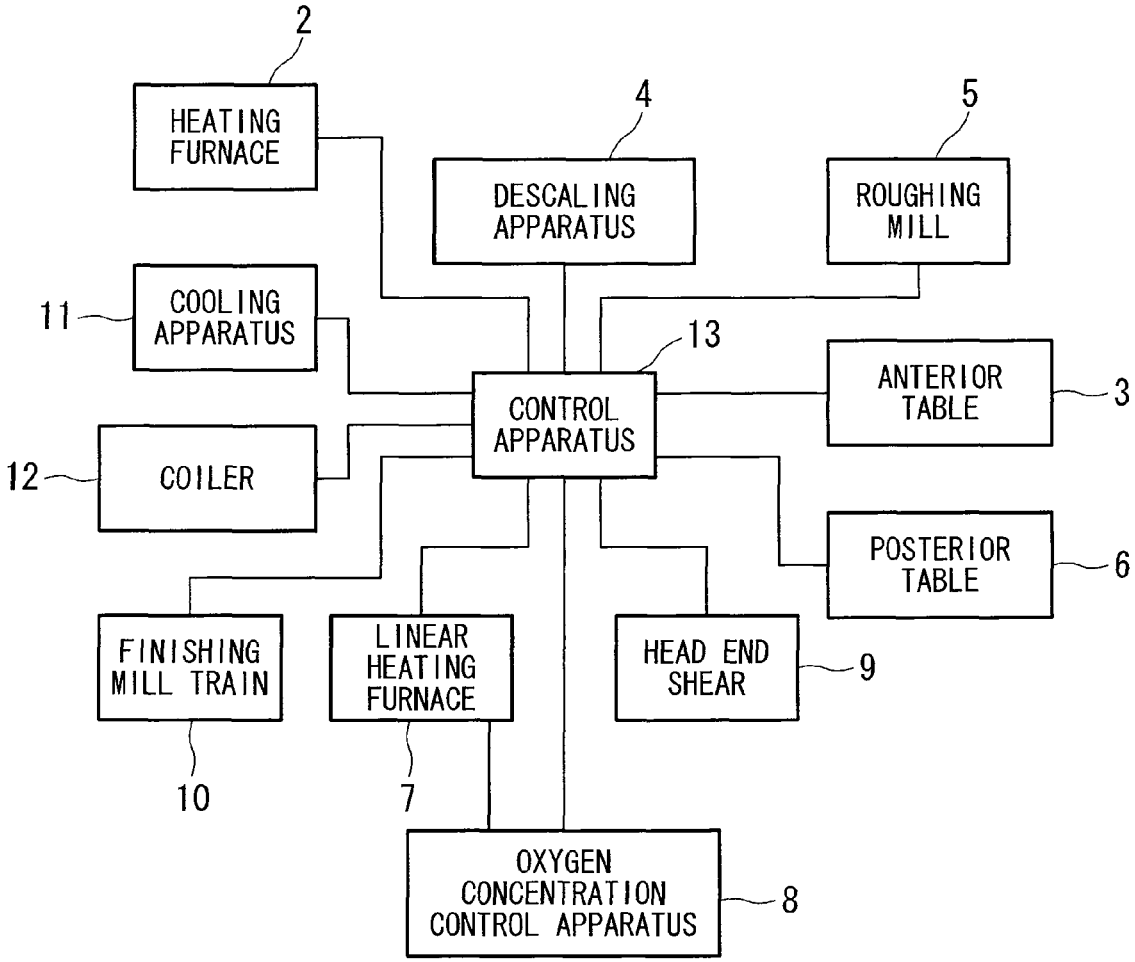
FIG. 2 is a block diagram showing a functional configuration of the hot rolling apparatus as the embodiment of the present invention.

FIG. 1 is a schematic block diagram showing a hot rolling apparatus as one embodiment of the present invention. FIG. 2 is a block diagram showing a functional configuration of the hot rolling apparatus as the embodiment of the present invention.

As is shown in these figures, a hot rolling apparatus 1 of the present embodiment includes: a heating furnace 2; an anterior table 3 (support table); a descaling apparatus 4; a roughing mill 5 (rough rolling device); a posterior table 6 (support table); a linear heating furnace 7 (heat retention/application treatment device); an oxygen concentration control apparatus 8 (oxygen concentration control device); a head end shear 9; a finishing mill train 10 (finish rolling device); a cooling apparatus 11 (cooling device); a coiler 12; and a control apparatus 13.

The heating furnace 2 heats a slab X (metal material, scrap material) including copper and mainly composed of steel to a temperature suitable for a rough milling treatment before the slab X is rolled through the roughing mill 5.

The anterior table 3 is located at the subsequent stage of the heating furnace 2. The anterior table 3 includes a plurality of table rolls arranged in the line direction. The anterior table 3 transfers the slab X having been carried out of the heating furnace 2 to the roughing mill 5 and also supports the slab X from below when the slab X is repeatedly rolled while being passed back and forth through the roughing mill 5, which will be described later.

The descaling apparatus 4 is placed directly before the roughing mill 5. The descaling apparatus 4 removes the primary scale formed on the surface of the slab X through the heating of the slab X in the heating furnace 2, or the scale produced in a rolling treatment in the roughing mill 5.

The roughing mill 5 includes a pair of mill rollers 51, 52 that are rotated. The roughing mill 5 rolls the slab X between the mill rollers 51, 52, to thereby mold the slab X into a metal plate Y. The mill rollers 51, 52 are rotary-driven synchronously. It is configured such that a direction of rotation of the mill roller 51, 52 is reversible. Therefore, it is possible to repeatedly roll the slab X while the slab X is moved back and forth.

The posterior table 6 includes a plurality of table rolls arranged in the line direction. The posterior table 6 transfers the metal plate Y having been carried out of the roughing mill 5 to the linear heating furnace 7, and also supports the slab X from below when the slab X is repeatedly rolled while being passed back and forth through the roughing mill 5.

The length of the posterior table 6 is set to be greater than the length by which the slab X protrudes from the roughing mill 5 in the final back-and-forth movement of the slab X from the roughing mill 5 toward the linear heating furnace 7. Note that the final back-and-forth movement here refers to a back-and-forth movement before the slab X is delivered from the roughing mill 5 to the finishing mill train 10 (a pass before the final pass). That is, the length by which the slab X protrudes from the roughing mill 5 in the final back-and-forth movement refers to a length by which the slab X protrudes from the roughing mill 5 before the slab X is finally delivered from the roughing mill 5 to the finishing mill train 10 (the pass before the final pass).

That is, in the hot rolling apparatus 1 of the present embodiment, the protrusion amount of the slab X when the slab X protrudes most in the linear heating furnace 7 direction from the roughing mill 5 is set to be greater than the length of the posterior table 6 in the last back-and-forth movement. Therefore, in the rolling treatment of the slab X in the roughing mill 5, the head end of the slab X never reaches the linear heating furnace 7. Hence, in the period of the rolling treatment of the slab X in the roughing mill 5, the slab X is never exposed to the internal atmosphere of the linear heating furnace 7.

The linear heating furnace 7 thermally retains or heats the metal plate Y, separately from the heating furnace 2. In the hot rolling apparatus 1 of the present embodiment, the linear heating furnace 7 thermally retains the metal plate Y at approximately 1100° C. In the linear heating furnace 7, it is possible to thermally retain the metal plate Y carried out of the roughing mill 5 without applying bending, over a length close to the whole length of the metal plate Y.

In the interior of the linear heating furnace 7, there are arranged a plurality of table rolls in the line direction. By the table rolls, the metal plate Y is movably supported.

The oxygen concentration control apparatus 8 is connected to the linear heating furnace 7. The oxygen concentration control apparatus 8 controls the oxygen concentration in the interior of the linear heating furnace 7 below 3%.

Figure 3:
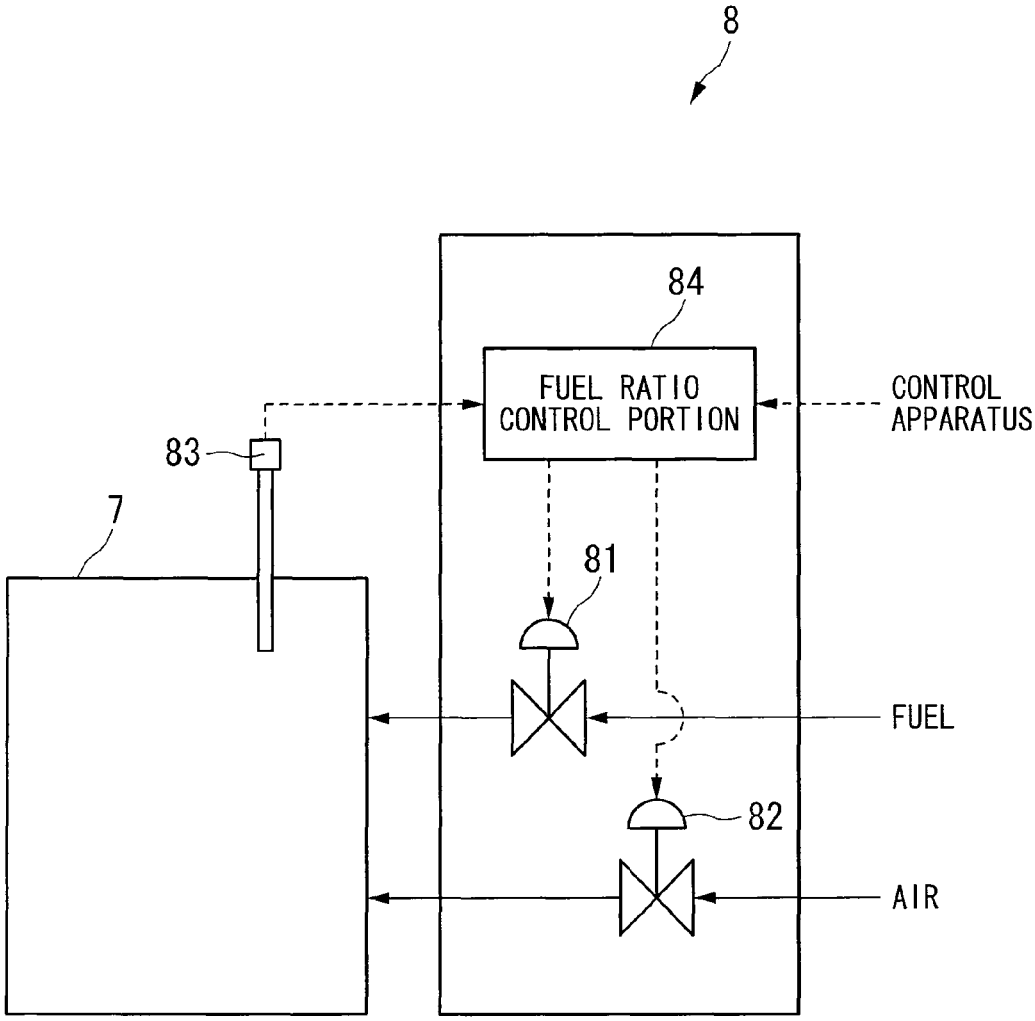
FIG. 3 is a schematic block diagram showing an oxygen concentration control apparatus provided in the hot rolling apparatus as the embodiment of the present invention.

FIG. 3 is a schematic block diagram of the linear heating furnace 7. As shown in the figure, the oxygen concentration control apparatus 8 includes: a fuel valve 81 for adjusting an amount of fuel supplied to a burner (for example, a regenerative burner or the like) provided in the linear heating furnace 7; an air valve 82 for adjusting an amount of air supplied to the burner; an oxygen analyzer 83 for analyzing and measuring the oxygen concentration in the linear heating furnace 7; and a fuel ratio control portion 84 for controlling the rates of openings of the fuel valve 81 and the air valve 82 based on the measurement result from the oxygen analyzer 83 and on a control signal supplied from the control apparatus 13.

Returning to FIG. 1, the head end shear 9 is placed at the subsequent stage of the linear heating furnace 7. The head end shear cuts the head end of the metal plate Y carried out of the linear heating furnace 7.

The finishing mill train 10 is made of a plurality of mills 101 arranged along the line. Each mill 101 is made of a plurality of mill rollers 10*a*. The finishing mill train 10 further rolls the metal plate Y having been carried out of the linear heating furnace 7, to thereby adjust its shape.

The cooling apparatus 11 is placed at the subsequent stage of the finishing mill train 10. The cooling apparatus 11 cools the metal plate Y whose shape has been adjusted by the finishing mill train 10. In the present embodiment, the cooling apparatus 11 cools the metal plate Y by water-cooling.

The coiler 12 is placed at the subsequent stage of the cooling apparatus 11. The coiler 12 coils the metal plate Y that has been cooled by the cooling apparatus 11.

The control apparatus 13 controls the whole operation of the hot rolling apparatus 1 of the present embodiment. As shown in FIG. 2, the control apparatus 13 is electrically connected with the heating furnace 2, the anterior table 3, the descaling apparatus 4, the roughing mill 5, the posterior table 6, the linear heating furnace 7, the oxygen concentration control apparatus 8, the head end shear 9, the finishing mill train 10, the cooling apparatus 11, and the coiler 12.

Next is a description of an operation of the hot rolling apparatus 1 of the present embodiment thus constructed. The operation of the hot rolling apparatus 1 is performed mainly by the aforementioned control apparatus 13.

First, in the heating furnace 2, the slab X is heated to a predetermined temperature. The heated slab X is supplied to the roughing mill 5 via the descaling apparatus 4. That is, the slab X is supplied to the roughing mill 5 after the primary scale formed on its surface is removed in the descaling apparatus 4.

The slab X having been supplied to the roughing mill 5 is passed back and forth a plurality of times (for example, three times) through the roughing mill 5. Through the repeated rolling, the slab X is molded into the metal plate Y.

Here, in the hot rolling apparatus 1 of the present embodiment, while being rolled through the roughing mill 5, the slab X is movably supported from below by the anterior table 3 or the posterior table 6. That is, while being rolled through the roughing mill 5, the slab X is moved on the anterior table 3 or the posterior table 6 without undergoing other heat treatments such as heat retention, or to other processes such as finish rolling.

The length of the posterior table 6 is set to be greater than the length by which the slab X protrudes from the roughing mill 5 in the final back-and-forth movement of the slab X in the direction from the roughing mill 5 toward the linear heating furnace 7. Therefore, while the slab X is being rolled through the roughing mill 5, the head end of the slab X is never exposed to the internal atmosphere of the linear heating furnace 7.

Furthermore, the descaling apparatus 4 is appropriately used, under the control of the control apparatus 13, to remove the produced scale.

The metal plate Y having been molded in the roughing mill 5 is supplied to the linear heating furnace 7 via the posterior table 6, and is thermally retained at approximately 1100° C. Then, secondary scale is formed on the surface of the metal plate Y while the metal plate Y is moving.

Here, in the hot rolling apparatus 1 of the present embodiment, the length of the linear heating furnace 7 is set to be close to that of the metal plate Y. Therefore, it is possible to store the metal plate Y in the linear heating furnace 7 without bending it.

Furthermore, in the hot rolling apparatus 1 of the present embodiment, the oxygen concentration in the interior of the linear heating furnace 7 is set to below 3% by the oxygen concentration control apparatus 8.

To be more specific, based on the measurement result of the interior of the linear heating furnace 7, which has been input from the oxygen analyzer 83, and on the instruction signal, which has been input from the control apparatus 13, for signifying a fuel ratio in accordance with the oxygen concentration to be set, the oxygen concentration control apparatus 8 uses the fuel ratio control portion 84 to control the rates of opening of the fuel valve 81 and the air valve 82, to thereby control the oxygen concentration in the interior of the linear heating furnace 7.

Figure 4:
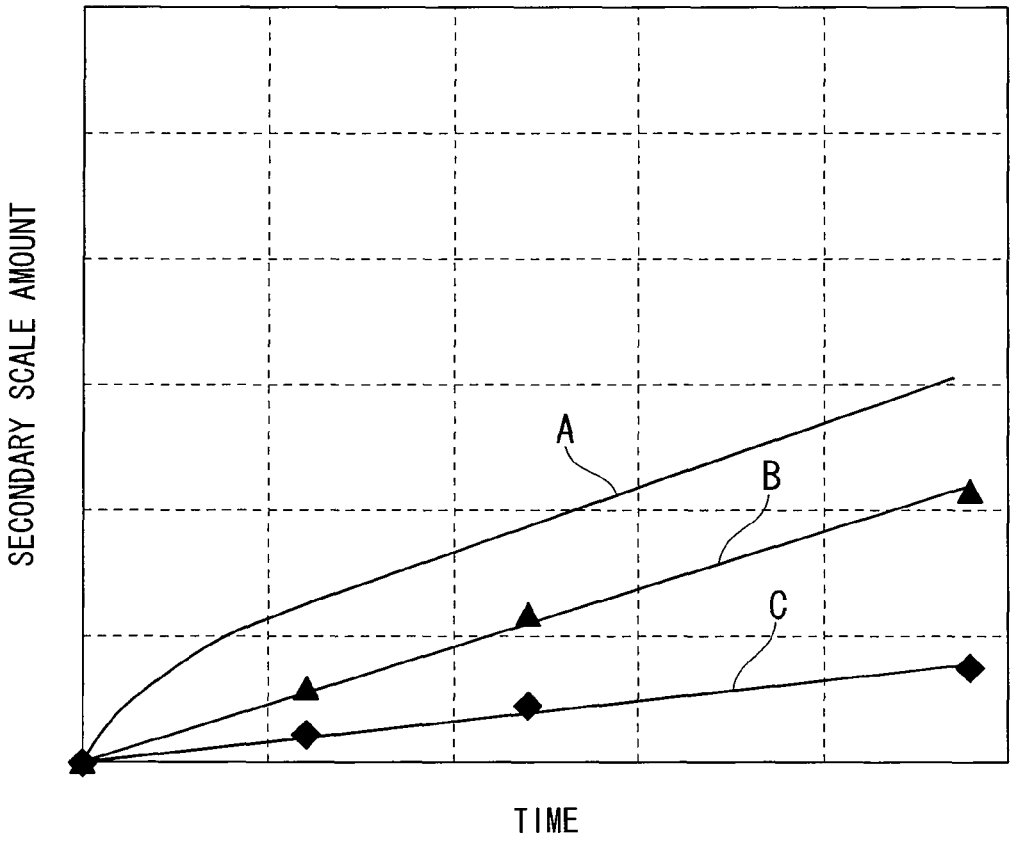
FIG. 4 is a graph showing a change in the amount of secondary scale when an internal atmosphere of a linear heating furnace of the hot rolling apparatus as the embodiment of the present invention is changed.

With the interior of the linear heating furnace 7 having its oxygen concentration retained below 3% in this manner, the oxygen concentration in the atmosphere when the metal plate Y is heat-retained is below 3%. FIG. 4 is a graph showing a chronological change in the film thickness of the secondary scale when the oxygen concentration in the interior of the linear heating furnace 7 retained at 1100° C. is changed. A graph A shows the case of an oxygen concentration of 5%, which is a typical value conventionally set. A graph B shows the case of an oxygen concentration of 3%. A graph C shows the case of an oxygen concentration of 1%.

As shown in the figure, in the case where the oxygen concentration is set to 3%, the film thickness, that is, the amount of produced secondary scale is approximately half that of when an oxygen concentration is 5%, which is a typical value conventionally set. In the case where the oxygen concentration is set to 1%, the film thickness of the secondary scale is further reduced.

Therefore, with the oxygen concentration in the interior of the linear heating furnace 7 being below 3%, it is possible to sufficiently reduce the amount of produced secondary scale.

The metal plate Y having been carried out of the linear heating furnace 7 has its head end cut by the head end shear 9. Subsequently, it is subjected to further rolling treatment by the finishing mill train 10 to a desired thickness.

Then, the metal plate Y having been subjected to the rolling treatment by the finishing mill train 10 is subjected to a cooling treatment by the cooling apparatus 11. Subsequently, it is coiled by the coiler 12.

According to such a hot rolling apparatus 1 of the present embodiment, the metal plate Y rolled by the roughing mill 5 is heat-retained by the linear heating furnace 7 without being bent. This prevents a metal plate Y on which a secondary scale is formed from being coiled. Therefore, damage, such as a microcrack, resulting from the metal plate Y becoming brittle can be prevented from occurring in the metal plate Y. According to the hot rolling apparatus 1 of the present embodiment, the metal plate Y is not heat-treated in a state of being coiled in the coil box. Therefore, the temperature distribution of the metal plate Y is made even, and the metallurgical properties of the metal plate Y are made even. Moreover, the quality of the metal plate Y is made uniform. Furthermore, with the temperature distribution of the metal plate Y being made even in the linear heating furnace 7, the temperature of the metal plate Y carried out of the finishing mill train 10 is also made even. This eliminates the necessity of fine temperature control in the cooling apparatus 11 associated with the modifications of rolling conditions. Therefore, it is possible to improve a processing speed in the cooling apparatus 11 and to reduce the size of the cooling apparatus 11.

According to the hot rolling apparatus 1 of the present embodiment, while the slab X is passed back and forth through the roughing mill 5, that is, while the slab X is rolled by the roughing mill 5, the slab X is movably supported from below by the anterior table 3 or the posterior table 6. Therefore, while being rolled by the roughing mill 5, the slab X is never made available for another process. As a result, while the slab X is rolled by the roughing mill 5, the transfer speed of the slab X is never under the control resulting from another process. Consequently, it is possible to improve the transfer speed of the slab X, that is, improve the rolling speed in the roughing mill 5.

Thus, according to the hot rolling apparatus 1 of the present embodiment, it is possible to improve the quality of the metal plate Y manufactured in the hot rolling apparatus 1, and also to improve the process speed.

According to the hot rolling apparatus 1 of the present embodiment, the oxygen concentration in the atmosphere of the heat treatment in the linear heating furnace 7 is maintained below 3% by the oxygen concentration control apparatus 8.

If the oxygen concentration in the atmosphere of the heat treatment in the linear heating furnace 7 is below 3%, it is possible to reduce the thickness of the secondary scale formed on the surface of the metal plate Y as described above. The thickness of the secondary scale is proportional to the amount of produced secondary scale, that is, the amount of precipitated copper in liquid form. Therefore, as in the present invention, the thickness of the secondary scale is reduced, which leads to a decrease in the amount of produced copper in liquid form. As a result, it is possible to prevent the metal plate Y from suffering from brittleness caused by the permeation of liquid crystal copper into the metal material grain boundary of steel or the like.

Therefore, according to the hot rolling apparatus 1 of the present embodiment, it is possible to improve the quality of the metal plate Y manufactured in the hot rolling apparatus 1.

While an exemplary embodiment of the hot rolling apparatus according to the present invention has been described above with reference to the drawings, it is obvious that the present invention is not limited to the above embodiment. Shapes, combinations and the like of the constituent members illustrated above are merely examples, and various modifications based on design requirements and the like can be made without departing from the spirit or scope of the invention.

For example, an inductive heating apparatus may be placed at the stage subsequent to the linear heating furnace 7 of the above embodiment, for a more accurate temperature control of the metal plate Y to be supplied to the finishing mill train 10.

In addition, a gas other than the combustion gas or the atmospheric air may be supplied to the interior of the linear heating furnace 7.

Furthermore, in the above embodiment, it is preferable that, when the metal plate Y is moved into the linear heating furnace 7, the transfer speed of the metal plate Y be decelerated to make small a collision impulse of the metal plate Y against the furnace wall.

Provided, a construction may be adopted in which an apron made of heat resistant steel is placed between a plurality of table rolls arranged in the interior of the linear heating furnace 7 to relieve a collision impulse when the metal plate Y is transferred in the interior of the linear heating furnace 7. With the adoption of such a construction, it is possible to improve the transfer speed of the metal plate Y in the linear heating furnace 7, to thereby further shorten the period of time for the process required to manufacture the metal plate Y from the slab X.

INDUSTRIAL APPLICABILITY

According to the present invention, it is possible to improve the quality of the metal plate manufactured in the hot rolling apparatus, and also to improve the speed of the process required for rolling.

What is claimed is:

1. A hot rolling apparatus for manufacturing a metal plate by hot-rolling-treating a metal material including copper, comprising:

a rough rolling device for rolling-treating the metal material, which has been heat-treated, a plurality of times with a back-and-forth movement of the metal material, to mold into a metal plate;

a heat retention/application treatment device for applying heat to the metal plate molded by the rough rolling device and retaining heat of the metal plate at lower temperatures than in the heating treatment, over its length after molding, without applying bending to the metal plate when applying heat thereto and retaining the heat thereof;

a finish rolling device for further rolling-treating the metal plate that has been heat-treated by the heat retention/application treatment device;

a cooling device for cooling the metal plate that has been rolling-treated by the finish rolling device; and a support table for movably supporting the metal material from below before and after the rough rolling device while the metal material is moved back and forth by the rough rolling device.

2. The hot rolling apparatus according to claim 1, wherein the support table further includes a posterior support table for movably supporting the metal material from below, between the rough rolling device and the heat retention/application treatment device, and the posterior support table whose downstream end is connected to the heat retention/application treatment device in series, a length of the posterior support table is set greater than a length by which the metal material protrudes from the rough rolling device in a final back-and-forth movement of the metal material from the rough rolling device toward the heat retention/application treatment device, and both of the support table and the heat retention/application treatment device are arranged in a straight line and are configured to transfer the metal material along the straight line.

3. The hot rolling apparatus according to claim 1, further comprising an oxygen concentration control device for maintaining an oxygen concentration in an atmosphere of the heat-treatment in the heat retention/application treatment device below 3%.

4. The hot rolling apparatus according to claim 3, wherein the heat retention/application treatment device includes a burner to heat the metal plate, the oxygen concentration control device includes a fuel adjusting device to adjust an amount of fuel supplied to the burner, and an air adjustment device to adjust an amount of air supplied to the burner, and the oxygen concentration control device is configured to control an oxygen concentration of an atmosphere in the heat retention/application treatment device by controlling the fuel adjustment device and the air adjustment device.

* * * * *

UNITED STATES PATENT AND TRADEMARK OFFICE

CERTIFICATE OF CORRECTION

PATENT NO. : 8,555,687 B2
APPLICATION NO. : 12/664472
DATED : October 15, 2013
INVENTOR(S) : Ishige et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 461 days.

Signed and Sealed this
Fifteenth Day of September, 2015

Michelle K. Lee

Michelle K. Lee
*Director of the United States Patent and Trademark Office*